United States Patent [19]

Yarygin et al.

[11] Patent Number: 4,521,245

[45] Date of Patent: Jun. 4, 1985

[54] METHOD OF PROCESSING SULPHIDE COPPER- AND/OR SULPHIDE COPPER-ZINC CONCENTRATES

[76] Inventors: Vladimir I. Yarygin, ulitsa Novoshkolnaya, 56, kv. 13.; Jury I. Sannikov, prospekt Lenina, 58/1, kv. 22.; Anatoly I. Panchenko, ulitsa Karbysheva, 26/1, kv. 98.; Anatoly P. Sychev, prospekt Lenina, 60, kv. 16.; Ivan G. Vikharev, ulitsa Kosmicheskaya, 5/1, kv. 20.; Vyacheslav P. Kuur, ulitsa Stakhanovskaya, 59/1, kv. 18.; Mels Z. Toguzov, prospekt Lenina, 24, kv. 14., all of Ust-Kamenogorsk, U.S.S.R.

[21] Appl. No.: 548,200

[22] Filed: Nov. 2, 1983

[51] Int. Cl.[3] ..... C22B 15/00

[52] U.S. Cl. ..... 75/21; 75/23; 75/73; 75/86

[58] Field of Search ..... 75/86–88, 75/7, 21, 23, 73

[56] References Cited

U.S. PATENT DOCUMENTS

| | | | |
|---|---|---|---|
| 3,563,726 | 2/1971 | Elvander | 75/23 |
| 3,892,560 | 7/1975 | Nermes | 75/23 |
| 3,948,639 | 4/1976 | Nermes | 75/23 |
| 4,300,949 | 11/1981 | Ushakov | 75/73 |
| 4,389,243 | 6/1983 | Jaquay | 75/23 |
| 4,415,356 | 11/1983 | Victorovich | 75/21 |

FOREIGN PATENT DOCUMENTS

| | | |
|---|---|---|
| 2515464 | 7/1977 | Fed. Rep. of Germany . |
| 1368167 | 5/1976 | Japan . |

OTHER PUBLICATIONS

The Development of Copper Ore Deposits and Production of Copper in Turkey (Mehmet Yasar Ethem) (German–English) pp. 147–197.

Development, Principles and Applications of the Kivcet Process of Cyclone Smelting of Contaminated Copper Ores with the Use of Pure Oxygen (Gerhard Melcher et al.) (German–English) pp. 309–369.

Nonferrous Metallurgy Abroad (Russian–English) pp. 25–29.

Physico–Chemical Principles of Kivcet Smelting Process with Reference to Copper–Zinc Concentrate Processing (I. M. Cherednik et al.) (Russian–English) pp. 24–27.

*Primary Examiner*—Peter D. Rosenberg

*Attorney, Agent, or Firm*—Ladas & Parry

[57] ABSTRACT

A method of processing sulphide copper- and/or sulphide copper-zinc concentrates comprises flash smelting of said concentrates and basic silicate fluxes in the presence of oxygen with the resultant formation of a dispersed mixture of highly basic molten slag containing copper and zinc oxides, metallic copper and white matte. The initial concentrates and silicate fluxes are taken in ratios permitting production of highly basic slag, whereupon copper and zinc oxides contained in the highly basic molten slag are reduced by means of a solid carbonaceous material with the resultant formation of a vapor-gas mixture containing vapors of zinc, metallic copper and depleted highly basic molten slag containing not more than 18 percent by weight of silicon dioxide. The resultant vapor-gas mixture is then subjected to oxidation with a view to producing and collecting zinc oxide.

10 Claims, No Drawings

METHOD OF PROCESSING SULPHIDE COPPER- AND/OR SULPHIDE COPPER-ZINC CONCENTRATES

The present invention relates to nonferrous metallurgy, and more particularly, to the production of nonferrous metals by a pyrometallurgical process. More specifically, it is concerned with processing of sulphide copper- and/or sulphide copper-zinc concentrates.

FIELD OF APPLICATION

The invention is applicable to the processing of a low-grade polymetallic material used for producing metallic copper, oxidized zinc sublimates and highly basic slags suitable for use as the starting material in other branches of industry.

BACKGROUND ART

In modern pyrometallurgical practice sulphide concentrates are treated by using the difference in chemical affinity of metals to oxygen and sulphur contained in the raw material. To increase this difference, the smelting process is carried out in the presence of silicon dioxide. The silicate melt is then reduced. It should contain basic oxides required to ensure high rate of reduction. Thus, in this case use is made of the difference between elements in their affinity to oxygen.

Further progress in pyrometallurgical production of heavy nonferrous metals depends on the development of effective techiques for their recovery on the basis of autogenous smelting of sulphide material. Advantages of autogenous processes are known to permit high production rate (short time of holding the material in the oxidation zone); a sharp decrease in the amount of process gases; utilizing heating capacity of the concentrates and thus substantially diminishing the use of external heat sources; the possibility of effective treatment of the raw material which is relatively poor in nonferrous metals. In general, there is known a wide variety of autogenous processes. However, a feature most common to most of them is the use of highly developed surface of the sulphide material with a view to ensuring autogenous nature of the roasting and smelting processes.

For example, the Ontokumpu company, Finland, has developed a method of processing sulphide copper concentrates. The method in question is carried out by using a flow of possibly preheated air (that can be oxygen-enriched) for flash smelting of finely divided sulphide copper concentrates. The smelting process is effected in the presence of substantially silicate fluxes with the resultant dispersed molten mixture of silicate slag and matte containing not more than 65 percent by weight of copper.

This dispersed mixture of slag and matte is separated in accordance with specific weights. The matte is further treated until metallic copper is recovered therefrom, while silicate slag is depleted in an electric furnace by settling or flotation after being crushed and divided.

The gases resultant from flash smelting of the initial material contain from 2 to 20 percent of sulphurous anhydride. The loss of partially oxidized powder concentrate during smelting is in the range of 8 to 10 percent by mass of the material fed for smelting (see, for example, Shein Y. P. "Nonferrous Metals", No. 8, 1980, pp. 25–29 [Symposium on Nonferrous Metallurgy in Finland]; Engineering and Mining Journal, 1973, 174, No. 11, p. 103–108; M. J. Ethem "Erzemetall", No. 4, 29, 1976, pp. 182–186).

There exist other modifications of this method, which are directed at enhancing its technical-and-economic characteristics. For instance, the content of copper in the matte is brought up by increasing the concentration of oxygen in the flow of air supplied for smelting, the temperature of air or that of oxygen-enriched air being raised. It has been attempted to increase the rate of recovery of copper from raw material by arranging electrodes in the zone where slags settled down to become free from matte. However, the above-mentioned improvements failed to obviate serious disadvantages inherent in the prior-art method, namely:

the impossibility of processing raw material with higher-than-average content of zinc, or combining the processing of copper-zinc concentrates with the stage of producing blister copper;

a low rate of recovery of copper and zinc from silicate slags.

To overcome difficulties that might possibly occur in the process of producing rich matte (with over 65% by weight of copper), blister copper, or during treatment of a low-grade material containing difficulty oxidizable zinc sulphide, and in order to bring down the amount of magnetite (and the content of copper in slag), it has been attempted to distribute the supply of oxygen required for oxidation of sulphide sulphur, and to perform smelting along with preroasting and subsequent utilisation of fuel.

According to Pat. No. 2,515,464 (Federal Republic of Germany, cl. C 22 B 15/04) the initial material is first partially roasted and then smelted to produce matte. As this happens, a flow of hot oxygen is introduced into the roast gases which are then used as auxiliary air for combustion of fuel in the course of smelting. However, the above method is rather difficult to perform apart from being ineffective to prevent the formation of magnetite. In addition, it fails to solve the problems associated with the processing of copper-zinc or copper zinc-bearing concentrates and with the depletion of slags to permit good recovery of nonferrous metals therefrom.

There is known a KIVCET process which comprises roasting and smelting of flotation concentrates, containing nonferrous metals, in the atmosphere of commercial oxygen mixed with resusable dust resultant from cleaning of flue gases, and substantially by with silicate fluxes thereby obtaining matte and reducing zinc from the silicate melt in an electric furnace (see, for example, Japanese Pat. No. 16362/76, cl. C 22 B 15/00; V. V. Vylegzhanin et al. "Nonferrous Metals", No. 1, 1976, pp. 26–28; I. M. Cherednik et al. "Nonferrous Metals", No. 7, 1974, pp. 24–27; Melcher G. et al. Erzmetall, 1975, 28, No. 7/8, p. 313–322, I, II, III).

The KIVCET process is as follows.

A finely divided copper- or copper-zinc concentrate is submitted to flash smelting in the presence of substantially silicate fluxes in the atmosphere of commercial oxygen, followed by the formation of a dispersed mixture of silicate slag and copper matte. The dispersed melt is further separated in accordance with specific weights into silicate slag and matte. Next, the slag and matte are admitted into an electothermic furnace, wherein a solid carbonaceous material (coke breeze) is charged onto the surface of the molten silicate slag. Under the influence of high temperature the zinc oxide contained in the slag is reduced to metal which, when evaporized, passes into a vapour-gas phase while copper oxides, also present in the slag, are reduced to metal and metallic copper is settled down to form matte. The vapour-gas mixture is removed from the electric furnace, the vapour of metallic zinc is oxidized therein to form zinc oxide by means of air supply. The resultant zinc oxide is collected to be fed for further treatment. The matte is tapped from the electric furnace for further treatment to be blown through and oxidized with oxygen. As a result of this treatment, metallic copper is produced to undergo subsequent refining.

In the KIVCET process, due to the use of commercial oxygen for oxidizing finely divided sulphide material with a high specific surface, and owing to smelting carried out to produce matte (up to 55% by weight of copper and about 20% by weight of sulphur), it takes only about 0.1 s for the oxygen fed for smelting to be almost completely assimilated by the sulphide material in suspension. As a result, a high temperature is developed during smelting to ensure sufficiently high rate of oxidation of zinc sulphide to its oxide with zinc oxide passing into silicate slag.

However, the above method of processing sulphide copper- or sulphide copper-zinc concentrates with the production of silicate slags also suffers from a number of serious disadvantages, namely:

1. The specific production rate at the stage of slag depletion is low by reason of the nature of slag used (from 4 to 12 kg of zinc per day per sq. meter of area in the electric furnace); hence are appreciably high losses of heat (power input) for slag depletion, as well as labour input per unit of commercial product.

2. The degree of recovery of zinc from raw material to produce zinc oxide is not higher than 80 percent.

3. The impossibility to treat sulphide concentrates with a high content of zinc (about 20% by weight of zinc) because of a low rate and degree of oxidation of zinc sulphide and its conversion into slag so as to enable further reduction of zinc oxide from slag with a satisfactory rate of zinc recovery from the initial material (more than 60–70%).

4. The processing of the resultant copper matte to produce metallic copper requires substantial capital investment and labour input apart from the necessity to develop a complicated emission gas control system.

5. The impossibility to prevent the formation of considerable amounts of magnetite during flash smelting of concentrates; therefore, complete oxidation of the afore-mentioned sulphide material leeds to the formation of high-viscosity dispersed mixture of silicate slag, metallic copper or white matte, which is rather difficult to disintegrate. In addition, the recovery of copper and zinc from high-viscosity silicate slag is fairly intricate procedure hindering comprenensive treatment of low-grade and, in particular, copper-zinc concentrates.

From the above it follows that new methods are required to substantially increase the rate of production at the stage of slag depletion along with corresponding decrease in the labour and power inputs; to bring up the rate of zinc recovery from the initial material; to raise the rate of oxidation of sulphide concentrates during flash smetlting, thereby permitting the production of metallic copper to be effected directly at this stage, as well as to bring down capital investments and labour force involved in the production of metallic copper; to prevent the formation of considerable amounts of magnetite during flash smelting of sulphide concentrates, which will make it possible to introduce a wider variety of initial materials into the copper and zinc industry by making use of low-grade copper and copper-zinc sulphide concentrates along with direct production of metallic copper.

It is an object of the present invention to provide such a method of processing sulphide copper- or sulphide copper-zinc concentrates or mixtures thereof that will make it possible to enhance the production capacity and the rate of smelting of the initial material.

Another object of the invention is to provide such a method of processing sulphide copper- or sulphide copper-zinc concentrates or mixtures thereof that will make it possible to increase the production capacity at the stage of slag depletion among with a higher rate of zinc recovery from the initial material, while permitting production of metallic copper or white matte.

The foregoing objects are attained in a method of processing sulphide copper- or sulphide copper-zinc iron-bearing concentrates, which comprises flash smelting of said concentrates in the presence of fluxes selected from the group consisting of basic fluxes and combinations thereof with silicate fluxes, and oxygen with the resultant formation of a dispersed mixture of slag, metallic copper or white matte, subsequent reduction of copper and zinc oxides, contained in the molten slag with a solid carbonaceous material, followed by the formation of a vapour-gas mixture containing zinc vapour, and of metallic copper and slag poor in nonferrous metals, subjecting to oxidation the vapour-gas mixture containing zinc vapour, and collecting the resultant zinc oxide, wherein, according to the invention, the initial concentrates and fluxes are fed for smelting in amounts sufficient to ensure the production of a highly basic molten slag which, on being reduced to give off copper and zinc oxides, contains not more than 18% by weight of silicon dioxide. Owing to such conditions, calcium oxide forms low-melting oxysulphide eutectics with zinc and iron sulphides at the intermediate stages of oxidation. With high-melting and difficulty oxidizable zinc sulphide passing into a low-melting liquid phase (just as the product of its oxidation-zinc oxide), the rate of the charge desulphurization (the rate of oxidation) is markedly increased. Further, in the process of smelting carried out to produce highly basic slag with the afore-mentioned ratio of the basic slag-forming components, there takes no place or hardly takes place any formation of magnetite which otherwise greatly increases viscosity of conventional silicate slags and thus hinders the process of oxidation. The present invention permits low-melting calcium ferrite to be formed instead of magnetite so as to dilute the products of oxidation and in this way to ensure the transportation of oxygen in the volume of droplets of the dispersed oxysulphide melt. Owing to these two main factors, that is—the formation of low-melting oxysulphide phases by means of calcium oxide and zinc and iron sulphides, and the formation of low-melting calcium ferrite instead of magnetite, it became possible to substantially intensify the process of desulphurization so that the copper sulphides present in copper are passed into metallic copper directly at the stage of oxidizing-flash smelting. In other words, copper is now produced directly from sulphide copper- or sulphide copper-zinc concentrates with the effect that the conversion of matte is ruled out to permit substantial cut-down of expenses and labour involved. Moreover, a considerable increase in the rate of oxidation of zinc sulphide has made it possible to perform effective treatment of zinc-bearing sulphide concentrates. This, in turn, greatly expands the variety of initial materials in the copper and zinc industries by making use of a low-grade sulphide material from which valuable components (copper, zinc and sulphur) are successfully extracted. Furthermore, since highly basic slag has a lower viscosity than silicate slag, the metallic copper or white matte formed during smelting is easily separated from the highly basic molten slag and passes into the bottom phase. This brings down the amount of copper lost with slag in the form of mechanical suspension (about 10 rel.%). The highly basic molten slag obtained during flash smelting contains the whole of zinc, a substantial amount of lead, with the content of copper in the form of oxide constituting about 5% by weight. The reduction of oxides of nonferrous metals (copper, zinc, lead) from highly basic molten slags proceeds at much higher rate than in the case of silicate slags and approaches the specific rate of the fuming process. In part, this takes place due to a higher intensity of the following reaction:

$$(n+2m)MeO+(n+m)C=(n+2m)Me+nCO+mCO_2 \quad (1)$$

with a corresponding increase in the activity of oxides of nonferrous metals contained in highly basic slags. Another reason for this are key changes in the coordination structure of metals in the highly basic slags as compared to silicate slags. In highly basic slags, the structure-determining component is calcium (coordination number—six) instead of silicon in the silicate slags (coordination number—four). Such structural transformations lead to a decrease in the amount of free energy and especially in that of free energy resultant from the activation of the following reaction:

$$FeO_{sl}=Fe_{sl}+Fe_2O_{3\,sl} \quad (2)$$

equivalent to the increase of its velocity by several orders. As a result, zinc, copper and lead oxides are reduced at a much higher rate in accordance with the following reactions:

$$ZnO+Fe_{sl}\rightarrow Zn\uparrow+FeO \quad (3)$$

$$Cu_2O+Fe_{sl}\rightarrow 2Cu+FeO \quad (4)$$

Thus, during carbon reduction of nonferrous metals from highly basic slags it is more difficult, as compared to silicate slags, for metallic iron to be separated into an independent phase or into blister copper. Therefore, with the content of nonferrous metals in the reduced slag amounting to 1–1.5% by weight (0.5 to 0.7% by weight of zinc, 0.3 to 0.5% by weight of copper, 0.01% by weight of lead), metallic copper containing 1 to 3% by weight of iron is found in equilibrium therewith. In contrast, the content of zinc in silicate slags under similar conditions of the melt reduction by means of solid carbonaceous material can not be lower than 3.5 to 4% by weight of zinc, which is due to the fact that substantial amount of iron passes into the bottom phase with its melting temperature sharply raising to render impossible deep depletion of silicate slag because of solidification of the bottom phase. Thus, for the total content of nonferrous metals to be in the range of 1–1.5% by weight, it takes 10 to 15 times more time for the depletion of silicate slags than for the depletion of highly basic molten slags. Furthermore, such deep depletion results in that copper is considerably contaminated with metallic iron (not less than 20% by weight of iron) with the melting temperature thereof being over 1400° C. From the above it follows that in comparison with the Japanese Pat. No. 16362/76 cl. C 22 B 15/00, it becomes possible not only to improve the process characteristics at the stage of flash smelting of sulphide concentrates to produce highly basic slags in the presence of oxygen, but to improve the process characteristics at the stage of slag depletion by using a solid carbonaceous material. To develop the point, the amount of zinc recovered from the initial material is substantially increased (from 75–80% to 94–97%), the rate of sublimation of volatile zinc is enhanced (from 4–12 to 40–60 kg/m$^2$ per day), with power and labour inputs per unit of commercial product (zinc oxide) being proportionally reduced.

According to the invention, the content of silicon dioxide in the depleted highly basic molten slag is preferably maintained within the range of 3 to 16% by weight with the use of silicate flux, whereafter the melt is cooled down to a temperature of its complete solidification at a rate of 0.5 to 60 degrees per minute with the resultant production of self-disintegrating material from which nonferrous metals are finally recovered. On the one hand, this will ensure moderate melting temperature of the melt, and the formation of sufficient amounts of dicalcium silicate during cooling and solidification of the melt, on the other. As the depleted highly basic molten slag is cooled down to a temperature of its complete solidification at a rate of 0.5 to 60 degrees per minute, this silicate is produced in the form of fairly pure large-size crystals (with average diameter of 40–80 mcm). At a temperature of about 675° C., the crystals of dicalcium silicate undergo polymorphic transformation, which is followed by a 12 to 15% increase in their volume. This, in turn, brings about interior strain in the slag monolith. Under the influence of this interior strain the monolith is spontaneously disintegrated to form particles of a size fit for flotation (the yield of this fraction is 75–85%). In addition, the temperature decrease at the above-indicated rate makes possible the separation of copper left in the slag in the form of droplets with a diameter of 80 mcm (about 70% of copper is recovered from the slag). Due to spontaneous disintegration of slag and with separation of copper therefrom in the form of droplets, the surfaces of which become exposed during spontaneous disintegration of the slag monolith, final extraction of copper from the depleted highly basic slag is simplified. Thus, with the content of copper in the depleted slag of 0.3 to 0.5% by weight, it is possible to obtain a concentrate by means of flotation with the content of copper ranging from 10 to 15% and with the discarded material containing from 0.1 to 0.15% by weight of copper (depending upon the initial content of copper). At the same time, following depletion, comminution and treatment of silicate slags by flotation, they still contain, as a rule, 0.5% by weight of copper (at best 0.3% by weight of copper). Therefore, when smelting is carried out to produce highly basic slags to undergo further treatment with carbonaceous material in order to obtain self-disintegrating depleted slag, the most arduous operations of the separating stage, such as crushing and dividing the solid monolith, are ruled out; the loss of copper with the discarded material is reduced from 1–1.5 rel.% to 0.3–0.6 rel.% (in contrast to the smelting followed by the formation of silicate slag).

According to the invention, the resultant metallic copper is preferably submitted to refining in the presence of silicate fluxes for the purpose of producing refined copper and silicate slag. It has been found that the metallic copper produced during treatment of copper- or copper-zinc sulphide concentrates contains impurities of lead, zinc, iron and other elements to be removed from metallic copper. As molten metallic copper is blown through with air in the presence of silicate fluxes, the above-mentioned impurities are ozidized to pass into silicate slag where oxides of the metallic impurities are combined to form strong low-volatile silicates and thus are removed from metallic copper. Simultaneously, copper is partially ozidized to form copper oxide which also passes into silicate slag and is partially dissolved in metallic copper to oxidize metallic impurities. Since during refining of metallic copper the melt is intensively mixed with air, the dissolving of silicate flux proceeds at a rapid rate even when large-size lumps of silicate flux are used. Therefore, with a view to reducing the loss of heat during transportation of metallic copper for refining, the latter is preferably delivered to this stage in molten state.

According to the invention, the metallic copper obtained during flash smelting of concentrates in the presence of oxygen in the course of treatment of the dispersed mixture of highly basic molten slag, metallic copper or white matte with a solid carbonaceous material, and the metallic copper obtained during treatment of highly basic molten slag with a solid carbonaceous material, are discharged separately.

It has been found that during flash smelting of copper- or copper-zinc concentrate in the presence of basic fluxes, the resultant metallic copper contains up to 90% of copper contained in the initial material fed for smelting. The metallic copper produced at the stage of flash smelting is preferably withdrawn from the process with only highly basic oxide melt being fed for carbon treatment. This permits the bulk of copper (up to 90 rel.%) to be obtained in the form of commercial product, the purest possible for the given type of initial material, whereas the copper residue in the oxide melt is preferably extracted in the form of less pure metal at the stage of carbon treatment of slag. The foreign-metal impurities such as lead, zinc and iron pass into metallic copper mostly in the form of metals which are obtained as intermediate products resultant from the reaction between corresponding sulphides and oxides, and according to reactions (2) and (3). Since in the process of flash smelting, due to high oxidation potential of the medium, the concentration of such intermediate products cannot be high (it has maximum value for lead), as also the degree of transition of lead, zinc and iron into metallic copper. At the stage of carbon treatment of the highly basic melt, the oxides of copper, lead, zinc and, in part, of iron are reduced to metals. It should be observed that with the residual total content of copper, zinc and lead in the oxide melt being 1 to 1.5% by weight, metallic copper containing up to 8% by weight of lead, up to 1.5% by weight of zinc and up to 2% by weight of iron will be in equilibrium therewith. However, since the bulk of copper contained in the initial material is recovered prior to the stage of carbon treatment in the purest possible form, the overall contamination of metallic copper with the above-mentioned impurities turns out to be 2 to 3 times lower during separate tapping in contrast to the practice when all copper is tapped following the stage of slag treatment. In addition, during separate discharging of metallic copper, direct recovery of zinc and lead in the form of sublimates inside the furnace is increased by 6 to 8 rel.%, which brings down the losses of these metals with metallic copper.

According to the invention, the silicate slag produced during refining of metallic copper is preferably used as the silicate flux, which may contain up to 50% by weight of copper, up to 10% by weight of zinc, up to 10% by weight of lead, since these metals are present in the slag basically in the form of oxides, the slag should be subjected to treatment with carbonaceous material. On the other hand, the slag resultant from refining of metallic copper contains silicon dioxide which is preferably introduced for processing copper- and copper-zinc sulphide concentrates so as to obtain a self-disintegrating slag monolith required for subsequent final recovery of nonferrous metals. Both of these tasks are successfully fulfilled if the above-mentioned slag is used as the silicate flux.

According to the invention, the silicate flux is preferably introduced for use in flash smelting of the concentrate. Due to the fact that high temperature (over 1500° C.) is developed in the course of flash smelting of sulphide concentrate in the presence of oxygen, a refractory material, such as quartz sand reduced to a size of minus 0.5 mm, is preferably used as the silicate flux. The presence of silicon dioxide in the furnace burden brings down the effect of formation of oxysulphide phases on the base of calcium oxide and copper and zinc sulphides. However, since silicate flux is fed for smelting in the form of a refractory material, the dissolving of silicon dioxide in the resultant highly basic melt takes place mainly when the process of oxidation of metal sulphides in suspension has been completed. Therefore, adversary effect of silicon dioxide on the flash smelting of sulphide concentrate turns out to be insignificant, with refractory silicate material being successfully used in the process.

According to the present invention, the silicate flux is preferably introduced into the molten highly basic slag produced flash smelting of the concentrate. This will make it possible to reduce the load with regard to the inert material (silicon dioxide) at the stage of flash smelting of sulphide concentrate. At the same time, this allows for the heat liberation processes during oxidation of metal sulphides and the heat absorption processes during dissolution of silicate flux in the highly basic melt to be run at minimum intervals. This technique is advised when the silicate slag resultant from refining metallic copper is used as the silicate flux, which containts all components predominantly in oxidized state. Since this type of silicate slag has relatively low temperature (about 1200° C.), it is readily dissolved in the dispersed highly basic slag having a temperature of more than 1500° C. However, to avoid oversaturation of the resultant melt with silicon dioxide and settling of refractory dicalcium silicate, the silicate slag from refining of metallic copper should be fed at regular intervals.

According to the invention the silicate flux is preferably introduced into the depleted highly basic molten slag, which permits proportional reduction in load with regard to an inert material at the stage of flash smelting of sulphide concentrate and at the stage of treatment of the highly basic molten slag with a solid carbonaceous material. In addition, the presence of silicon dioxide at the stage of treatment of the highly basic melt somewhat brings down the process rate and leads to an increase in the melting temperature of the melt (up to 1330° C., with the content of silicon dioxide in the melt being 20% by weight). Therefore, when treatment of the highly basic melt is carried out with the content of silicon dioxide (determined by the composition of sulphide concentrate) being at its lowest, the rate of flash smelting for the given type of concentrate is the highest and the rate of recovery of nonferrous metals from the highly basic slag is maximal.

According to the present invention, the depleted silicate slag poor in nonferrous metals is preferably used as the silicate flux. This is advised when silicate flux is introduced into the highly basic slag poor in nonferrous metals. However, the content of nonferrous metals (copper, lead) should be more than 0.5% by weight. Such a low content of nonferrous metals in silicate slag permits their extraction to produce the concentrate after obtaining self-disintegrating slag monolith and final recovery of nonferrous metals, for example, by flotation methods. The current pyrometallurgical techniques used for smelting copper with the resultant formation of silicate slag make it possible to bring the content of copper therein up to 0.5% by weight, this being much higher than with the method of the present invention (0.1–0.15% by weight of copper). Therefore, such depleted silicate slags may be used in the given method.

Further objects and advantages of the present invention will become more apparent to those skilled in the art upon a further reading of this disclosure, particularly when viewed in the light of illustrative examples.

DETAILED DESCRIPTION OF THE PREFERRED EMBODIMENT

Sulphide copper concentrate normally containing 15 to 30 percent by weight of copper, 20 to 35 percent by weight of iron, 27 to 40 percent by weight of sulphur, up to 4 percent by weight of silicon dioxide, or sulphide copper-zinc concentrate containing 6 to 20 percent by weight of copper, 4 to 24 percent by weight of zinc, 25 to 30 percent by weight of iron, up to 3.5 percent by weight of lead, 30 to 35 percent by weight of sulphur, up to 6 percent by weight of silicon dioxide, as well as aluminium and magnesium oxides, are produced by means of flotation from copper- and copper-zinc ores reduced to a size fraction of minus 74 mcm. Where complex ores are subjected to dressing by flotation, preference may be given to the production of either monometallic (copper or zinc) concentrates or polymetallic (copper-zinc) concentrates, depending on the morphology of ores. This being done to increase the content of nonferrous metals in the resultant concentrates. According to the invention, the copper- or copper-zinc concentrate with a size particle of 74 mcm is mixed with lime flux (calcium carbonate, hydrated lime, calcium oxide) reduced to a size of minus 1 mm. The resultant mixture of concentrates and fluxes is dried to a residual humidity of about 1% by weight. The dried mixture prepared from finely divided concentrates and fluxes is fed into a mixer which is continuously supplied with the dust collected in an emission gas control system. Then, by means of a charge-oxygen burner, arranged in the melting chamber, the mixture of concentrates, fluxes and reusable dust is continuously injected in a flow of oxygen into the melting chamber wherein the mixture is pulverized to become suspended. Under the influence of high temperature, which has risen in the shaft in the course of burning of the preceding portions of similar mixture, the sulphide material is ignited in the presence of oxygen, the rate of its oxidation is accelerated and, under the influence of liberating heat, calcium carbonate is decomposed to produce calcium oxide. The resultant calcium oxide and non-oxidized particles of sulphides of nonferrous metals and iron, as well as zinc, copper, iron and lead oxides resultant from their oxidation, are dissolved in one another to form low-melting oxysulphide phases which continue to interact with oxygen to produce sulphurous anhydride and metallic copper or white matte. At this stage, silicon dioxide and aluminium oxide present in the mixture, pass into the melt of oxides. Thus, a dispersed mixture of metallic copper or white matte and highly basic molten slag with zinc, lead and copper oxides dissolved therein, descend to the shaft bottom to settle on the surface of the melt disposed therein. This dispersed mixture is separated according to specific weights in two layers, of which one layer is highly basic molten slag and the other is metallic copper or white matte. At this stage, the rate of recovery of copper to obtain the above-mentioned products (copper or white matte) reaches 90% of the amount of copper contained in the initial material supplied for smelting, with the rate of recovery of such foreign-metal impurities as lead, zinc and iron to obtain metallic copper or white matte being minimal. Therefore, metallic copper or white matte is withdrawn from the process after the stage of flash smelting and separation into layers of the dispersed mixture, while highly basic slag is fed for treatment to extract therefrom zinc, lead and the residue of copper dissolved in the form of oxide (3 to 6 percent by weight of copper). The gaseous products resultant from smelting of sulphide concentrates, which contain more than 99% of sulphide sulphur fed for smelting (to produce metallic copper) or about 85% of sulphide sulphur fed for smelting (to produce white matte) are directed together with dust to a dust collecting system wherein hard particles are separated from gases and continuously returned for flash smelting of the initial sulphide material. Free from hard particles and having a high content of sulphurous anhydride (up to 80% by volume), these gases are then used for the recovery of sulphur. To perform depletion of highly basic molten slag, the latter is tapped into an electric furnace while a solid carbonaceous material (coke breeze or coal) is charged onto the surface of the melt. The carbonaceous material is introduced in an amount sufficient to provide for the reduction of copper, lead and zinc oxides. Under the influence of high temperature, copper oxide is reduced to metallic copper settled down at the bottom of the electric furnace, and zinc oxide passes into metallic zinc which is volatilized to be removed together with carbon oxide and carbon dioxide from the electric furnace in the form of a vapour-gas mixture. Under these conditions, lead oxide is also reduced to metal and metallic lead is partly (by 30 to 40%) passed into metallic copper and is partly volatilized to be removed from the electric furnace in the form of the above-mentioned vapour-gas mixture. This mixture may be either cooled with zinc and copper condensed in the form of metallic alloy, or else it can be mixed with air. At the same time, the vapours of metals will pass into corresponding oxides, with CO oxidized to $CO_2$. The oxides of zinc and lead are collected to be fed for further treatment. The metallic copper obtained during treatment of highly basic molten slag is removed from the furnace to undergo refining. After treatment, the slag is tapped from the furnace either continuously or intermittently. It is suitable for further use in other braches of industry, for example, in the production of cement.

In order to obtain impoverished slag in the form of a self-disintegrading material, it is necessary that the impoverished molten slag with the amount 3 to 16 percent by weight of silicon dioxide contained therein should be produced by adding silicate flux. Thereafter, the highly basic molten slag is cooled to a temperature of its complete solidification (about 1000° C.) at a rate of 0.5 to 60 degrees per min. Where quartz in used as the silicate flux, it is preferably introduced in the form of quartz sand with a particle size of minus 0.5 mm in mixture with lime flux at the stage of flash smelting of sulphide concentrate. Since high temperature (over 1500° C.) is developed during flash smelting of sulphide concentrate in commercial oxygen, the crushed refractory silicate flux rapidly passes into the resultant highly basic molten slag directly at the stage of flash smelting. The amounts of lime and silicate to be added to the given sulphide concentrate are determined by appropriate calculations normally used in metallurgical practice. For instance, the composition of slag with regard to its main components /CaO, $SiO_2$, MgO, $Al_2O_3$, FeO, $Fe_2O_3$/ is determined either experimentally or on the strength of chemical analysis. This type of slag could be produced during smelting of the concentrate in the absence of fluxes. It is to be assumed for the sake of simplicity, that nonferrous metals are removed completely, and the overall content of the main components is calculated in such a slag. With a prescribed content of calcium oxide and silicon dioxide in the highly basic slag, the amounts of components ($SiO_2$ and CaO) to be introduced into the process are determined in accordance with constitutive relation. Then, corrections are introduced with regard to the contents of lime and silicon dioxide in the selected lime and silicate materials. Since the calculation is made for the depleted slag, it is of no importance at what stage a given type of flux is introduced.

The depleted highly basic melt containing from 3 to 16% by weight of silicon dioxide, used to produce a slag monolith prone to spontaneous disintegration with the resultant particles having minus 74 mcm in size, should be cooled down to a temperature of its complete solidification at a rate of 0.5° to 60° per min. To maintain the rate of cooling of the molten slag within the above range, the depleted highly basic slag is poured into ladles so as to permit the melt to be cooled in the air during its natural convection. For example, with the ladle external surface to the ladle volume ratio being 4 $m^2/m^3$, the melt is cooled to a temperature of its complete solidification at the rate of 3 deg. per min. The effect of the slag spontaneous disintegration is observed at a temperature of 600°–500° C. In the process of cooling and solidification of the melt, about 80 rel.% of the residual amount of copper is separated in the form of regulus of metallic copper with a particle size being 40 to 50 mcm. After comminution of the obtained powder slag, the regulus-formed metallic copper is treated by flotation methods to yield copper concentrate with the content of copper not lower than 8 wt.% (the yield of concentrate being less than 6% by weight of slag), so that the amount of copper in the tailings of flotation, with the initial content of copper in the depleted highly basic slag of 0.5 wt,%, remains in the range of 0.1 to 0.15 percent by weight of copper. The controlled comminution does not require much power input, since after cooling the melt at a rate of 0.5 to 60 deg. per minute, coarse particles of slag (amounting to 15–20% by weight of slag) have very low mechanical strength. The tailings of flotation are suitable for other commercial applications with iron and calcium oxides contained therein as basic components (the overall amount being 60 to 70 wt.%).

According to the present invention, the metallic copper obtained during processing of sulphide copper- or sulphide copper-zinc concentrates is subjected to refining preferably in the presence of silicate fluxes with the resultant production of purified copper and silicate slag. Thus, the properties of silicate flux can be used to combine zinc, lead and iron oxides, resultant from refining of metallic copper, into respective silicates. This makes it possible to bring down the waste of metals carried away with dust during refining of metallic copper. Furthermore, in the course of refining of metallic copper in the presence of silicate fluxes, the rate of their dissolution is enhanced due to intensive stirring of molten copper during its refining. The flows of reusable materials are also diminished due to the fact that the slag resultant from refining of metallic copper contains several components required for the process, namely, silicon dioxide, copper, zinc and lead.

According to the invention, the metallic copper obtained during flash smelting of the concentrate in the presence of oxygen and the metallic copper obtained during treatment of the highly basic molten slag with a solid carbonaceous material, are preferably discharged separately. As a result, the bulk of copper (up to 90 rel.%) is obtained in the form of commercial product, the purest possible for the given type of initial material. The residual amount of copper is recovered from the oxide melt in the form of more contaminated metal at the stage of carbon treatment of slag. Such foreign-metal imporities as lead, zinc and iron pass into metallic copper mainly in the form of metals resultant as intermediate products from the interaction of corresponding sulphides and oxides, and in accordance with reactions (2) and (3). Since oxidation potential of the medium is fairly high during flash smelting in the presence of oxygen, the concentration of such intermediate products cannot be high (it is at its maximum for lead). Hence is relatively small degree of transition of lead, zinc and iron into metallic copper. At the stage of carbon treatment of the highly basic melt, copper, lead, zinc and partly iron oxides are reduced to metals. With the residual amount of copper, zinc and lead in the melt being 1–1.5% by weight, metallic copper containing up to 8% by weight of lead, up to 1.5% by weight of zinc and up to 2% by weight of iron, will be in equilibrium therewith. Since, however, the bulk of copper fed with the initial material is extracted before the stage of carbon treatment in the purest form, the total contamination of metallic copper with the above-mentioned inclusions during separate discharging turns out to be 2–3 times lower than at a time of discharging the whole of copper following the stage of slag treatment. In addition, during separate discharge of metallic copper, the direct recovery of zinc as well as lead in the form of sublimates in the electric furnace is raised by 6 to 8 rel.% due to a decrease in the waste of these metals lost with metallic copper. Thus, separate discharging and separate refining of metallic copper make it possible to bring down the overall duration of the copper refining cycle and the amount of resultant slags with zinc and lead oxides concentrated therein and with copper oxide passing thereinto.

The silicate slag obtained during copper refining process is preferably used as the silicate flux in the process of treatment of sulphide copper- and sulphide copper-zinc concentrates. Thus, the process of transition of silicate flux into the highly basic molten flux is accelerated, since the slag melting temperature is at least 500° C. lower than the melting temperature of silicon dioxide. Therefore, this type of slag is precrushed to a size of minus 10 mm before it is into the charge fed for flash smelting of the sulphide concentrate, or into the dispersed highly basic slag obtained during flash smelting of the concentrate. The amount of silicate slag to be introduced into the charge so as to obtain depleted slag with the content of silicon dioxide therein ranging from 3 to 16 wt% is calculated in a manner similar to that described above. Silicate flux can be introduced into the highly basic molten slag resultant from flash smelting of sulphide concentrate. The introduction of silicate flux after the melting process is conducive to maintaining high rate of interaction between metal sulphides and the gas-phase oxygen in the course of flash smelting, insofar as silicon dioxide brings down the degree of mutual solubility of sulphides and calcium oxide with the formation of oxysulphide low-melting phases which act to step up interaction of the sulphide concentrates with the gas-phase oxygen. This procedure is advisable when the silicate flux used is a low-melting material (with a melting temperature of about 1200° C.) containing nonferrous metals which could be extracted during subsequent treatment of highly basic molten slag with a solid carbonaceous material. Such silicate slag is first precrushed (with fraction size of minus 10 mm) and then charged into the melting chamber. It is fed substantially continuously so as to avoid local supersaturation and supercooling of the melt and to step up the process of assimilation of the silicate flux by the highly basic molten slag. For example, the slag resultant from refining of metallic copper may be used as the silicate flux in question.

Silicate flux can also be introduced into the charge used for flash smelting of the sulphide copper- or sulphide copper-zinc concentrate, with the material used as the silicate flux having a high content of silicon dioxide and, consequently, high melting temperature, as well as containing sulphide sulphur. For example, the tailings resultant from treatment of sulphide ores, which along with silicon dioxide (over 60 wt.%) contain ferrix sulphides, are frequently used as the silicate flux. In this case, owing to the fact that the introduction of ferric sulphides provides for additional liberation of heat in the course of their oxidation in suspension, the oxidation of sulphide concentrates is not impaired despite the introduction of silicate flux into the charge. Such silicate flux is preferably ground to a particle size of up to minus 0.5 mm, which permits silicon dioxide to be dissolved in the dispersed highly basic molten slag at the final stage of flash smelting of sulphide concentrate in mixture with fluxes.

In addition, the silicate flux is preferably introduced into the highly basic molten slag after the latter is depleted. This permits the highly basic molten slag to be treated with a carbonaceous material whibe preserving a minimum content of silicon dioxide in the melt for the given type of initial material. This permits oxides of nonferrous metals to be reduced at a high rate by means of carbonaceous material and leads to a higher production rate at the stage of depletion. While making use of this technique, it is advisable to employ silicate flux with a low melting temperature (about 1200° C.). In addition, it should be precrushed to have a particle size of minus 10 mm before being fed for use. While the slag treating process is carried out intermittently with regard to its tapping from the electric furnace, the silicate slag is discharged prior to tapping the depleted slag. With the depleted slag being discharged continuously, the silicate flux is likewise charged continuously into the slag tapping in the electric furnace.

The silicate slag poor in nonferrous metals is preferably used as the silicate flux. Silicate slags obtained at present during pyrometallurgical smelting of copper contain copper and other metals in an amount of about 0.5% by weight of copper, which significantly surpasses the minimum (0.1–0.15% by weight of copper) obtainable with the method of the invention. Therefore, by using depleted silicate slags as the silicate flux to be introduced into the highly basic molten slag after its depletion, it is possible to recover from 60 to 80 rel.% of copper introduced together with the silicate slag.

The method of the invention can be performed by oxidizing the initial material in a solid-phase state until its complete desulphuriazation (or until copper to sulphur weight ratio is about 4:1, ensuring formation of white matte). Then, necessary fluxes are added to the resultant roasted product, the charge is melted to produce highly basic molten slag, metallic copper or white matte, whereupon the highly basic melt is treated with a carbonaceous reducing agent.

The method of the invention can be successfully performed by means of conventional metallurgic equipment. For example, highly efficient fluidized-bed roasting furnaces now in use are well suited for roasting and oxidizing processes. Therefore, there is no need in constructing special metallurgical units for flash smelting of sulphide concentrates.

In addition, the present invention permits the use of a method as described in Japanese Pat. No. 16362/76, according to which zinc vapour, obtained during treatment of highly basic molten slag with a carbonaceous material, are cooled and condensed to produce metallic zinc.

From the above it follows that the method of processing copper or copper-zinc sulphide concentrates is in many ways superior to the prior-art methods, its advantages being the following:

the conversion of copper matte is expelled from the operating process;

the recovery of sulphur contained in gases rich in sulphurous anhydride is effected in a single stage;

full utilization is made of the heating capacity of the sulphide material;

a complex zinc-bearing material is oxidized at a fairly high rate;

the degree of recovery of zinc in oxidized zinc sublimates is substantially enhanced;

the rate of zinc evaporation is upped several times during electrothermic treatment of slags;

the process of treatment is characterized by a low residue of nonferrous metals in slag (the total amount of 1% by weight);

the depleted slag may be obtained in the form of a self-disintegrating product, which facilitates final recovery of nonferrous metals therefrom;

power inputs are brought down approximately in proportion with the increase in the production rate at the stage of electrothermic treatment.

The method of the invention also allows processing of sulphide copper- or copper-zinc concentrates with the content of lead substantially exceeding 4 wt.%, in particular, copper-lead-zinc concentrates (10–20 wt.% copper, 6–20 wt.% lead, 10–15 wt.% zinc), as well as lead-zinc and lead sulphide concentrates (up to 70 wt.% lead, about 3 wt.% copper, up to 16 wt.% zinc), since the behaviour of lead compounds at the stage of flash smelting in the presence of oxygen and at the stage of reduction of the highly basic melt is fairly similar to the behaviour of analogous copper compounds, while the presence of lead has almost no effect on the above-described process of obtaining zinc in the form of a commercial product.

The invention will be further described by the following illustrative Examples.

EXAMPLE 1

A sulphide copper concentrate with a particle size of minus 74 mcm, produced by flotation from copper ore and having the following composition, in percent by weight:

copper: 23.25
iron: 30.58
sulphur: 35.49
zinc: 0.15
lead: 0.01
silicon dioxide: 1.8
calcium oxide: 2.57
aluminum oxide: 1.44
magnesium oxide: 0.99 was used as the initial material. A precrushed limestone (with a fraction size of minus 1 mm) was added to the initial material as calculated in terms of pure calcium oxide taken in an amount of 20% by weight of the initial sulphide material. The charge was then dried until its humidity was about 1% by weight.

The resultant dried charge was continuously fed into a mixer, with the dust resultant from cleaning of gases produced in the course of flash smelting being continuously introduced into the charge in the mixer. The charge mixed with dust was suspended in a flow of commercial oxygen (380 $nm^3$ per ton of concentrate) by means of an oxygen burner so as to be intermittently introduced into the melting charge. Specific load in terms of the charge in the melting zone was 50 tons per 1 $m^2$ per day. Under the influence of high temperature, the charge was ignited in the presence of oxygen, then melted with calcium carbonate passing into oxide; sulphide sulphur was oxidized to sulphurous anhydride. Thus, a dispersed mixture of metallic copper and highly basic molten slag descended to the bottom of the shaft onto the surface of the melt. Directly under the flame in the zone of flash smelting, the dispersed mixture was separated into two layers in accordance with specific weights, of which one was metallic copper and the other molten slag. The metallic copper obtained during flash smelting was periodically discharged (because of insufficient volume of the metallurgical unit), while slag was continuously fed into the electric furnace. The gases resultant from flash smelting were directed together with dust for treatment. The collected dust was continuously returned into the charge fed for flash smelting of sulphide concentrate. The highly basic slag incoming to the electric furnace contained, in percent by weight:

copper: 3.23 (in the form of oxide)
zinc: 0.18
calcium oxide: 29.1
iron: 39.47
silicon dioxide: 2.97

The yield of slag was 77.5% by weight of the concentrate, and 25.03 kg of copper in the form of copper oxide was introduced together with the slag into the electric furnace per ton of concentrate. According to stoichiometric requirements, 4.7 kg of carbon is needed for copper oxide to be reduced to metal. Coke breeze was charged into the electric furnace onto the melt surface in an amount of 9.7 kg per ton of concentrate as calculated in terms of pure carbon. Metal oxide from the molten slag was reduced by means of carbon to metallic copper which was deposited at the bottom of the electric furnace. Specific load of the electric furnace in terms of slag during its treatment with coke breeze was 10 tons per sq.meter per day. The carbon oxide resultant from the reduction of slag was removed from the electric furnace with a small amount of zinc vapour, whereupon it was mixed with air and oxidized to $CO_2$ and zinc oxide which was collected in the form of dust. Metallic copper and depleted highly basic slag were periodicaly discharged from the electric furnace.

Metallic copper was subjected to refining in a manner that silicon dioxide was introduced onto the surface of molten copper in the form of quartz in an amount of 4–5 kg of silicon dioxide per kg of iron. Then a flow of air was blown through the molten copper to produce refined copper (99.2 wt.% copper) and silicate slag containing 36.6 wt.% copper, 0.3 wt.% zinc, 0.1 wt.% lead, 9.2 wt.% iron, 0.9 wt.% calcium oxide, 1.5 wt.% aluminum oxide, 43.5 wt.% silicon dioxide.

The total amount of copper extracted from the concentrate in metallic copper was 99.33%; the amount of copper recovered during flash smelting of the concentrate was 89.33%, and during depletion of the highly basic melt in the electric furnace —10.10% of copper fed with the concentrate. The content of copper in the depleted slag was 0.21 wt.% and that of zinc 0.09 wt.%.

The metallic copper produced during flash smelting of the concentrate had the following composition, in percent by weight:

copper: 98.68
iron: 0.07
zinc: 0.001
lead: 0.005
sulphur: 0.15

The metallic copper obtained during treatment of slag in the electric furnace contained, in percent by weight:

copper: 95.88
iron: 1.35
zinc: 0.001
lead: 0.039
sulphur: 0.16

Average quality characteristics of metallic copper obtained at the both stages, in percent by weight:

copper: 97.18
iron: 0.22
zinc: 0.001
lead: 0.019
sulphur: 0.16

The refined metallic copper contained, in percent by weight:

copper: 99.2
iron: 0.01
zinc less than: 0.001
lead: 0.001
sulphur: 0.02

The recovery of copper from the concentrate was 98.4% of the amount of copper fed for smelting, with 0.89 rel.% passing into reusable silicate slag.

Basic process parameters of Example 1 are given in Table 1.

TABLE 1

| Nos 1 | Characteristics 2 | Ex. 1 3 | Ex. 2 4 |
|---|---|---|---|
| | Basic Process characteristics of sulphide copper concentrates treatment | | |
| 1. | Specific production rate at the stage of flash smelting of concentrate and fluxes, tons per day per sq. meter of area under smelting and oxidation | 50 | 50 |
| 2. | Flow rate of oxygen per ton of concentrate (100% $O_2$), $nm^3$ | 380 | 335 |
| 3. | Average composition of tbe copper-containing product obtained after treatment of initial material, wt. % | metallic copper | white matte |
| | copper | 97.18 | 76.65 |
| | iron | 0.22 | 2.19 |
| | zinc | 0.001 | 0.06 |
| | lead | 0.019 | 0.024 |
| | sulphur | 0.11 | 20.38 |
| 4. | Composition of slag with regard to nonferrous metals after its treatment with carbonaceous material in electric furnace, wt. % | | |
| | copper | 0.21 | 0.23 |
| | zinc | 0.09 | 0.06 |
| 5. | Tbe content of copper and sulphur in the processed product, in percent of that introduced with sulphide material | | |
| | copper | 99.33 | 99.05 |
| | sulphur into gases | 99.9 | 85.4 |
| 6. | Production capacity of electric furnace in terms of slag during its treatment with carbonaceous material, $t/m^2$ per day | 10 | 8 |

EXAMPLE 2

The method is carried out as described in Example 1, except that as a result of smelting white matte was produced (with the flow rate of oxygen being 335 $nm^3$ per ton of concentrate).

The test results are given in Table 1.

As proceeds from Examples 1 and 2, it becomes possible, during both flash smelting followed by the production of white matte or during smelting followed by the production of metallic copper, to ensure:

a high content of copper in metallic copper and of zinc in zinc sublimates at a low degree of reduction of iron to metallic iron;

a low content of copper and zinc in the depleted slag resultant from the treatment of melt with a solid carbonaceous material;

a low degree of iron transition into metallic copper, which brings about a fusion temperature close to the fusion temperature of pure metallic copper (1083° C.).

Such combination of process characteristics permits effective processing of the sulphide copper- and sulphide copper-zinc concentrates to be carried out with resultant production of metallic copper, zinc sublimates and of slags poor in copper and zinc after performing oxidizing roasting and smelting of the above-mentioned sulphide concentrates.

EXAMPLE 3

Initial sulphide copper-zinc concentrate, containing the following components in percent by weight:

copper: 22.08
zinc: 8.69
lead: 1.59
iron: 24.41
sulphur: 32.71
silicon dioxide: 1.25
calcium oxide: 1.01
magnesium oxide: 0.05
aluminium oxide: 0.03, was mixed with limestone crushed to a particle size of minus 1 mm as calculated in terms of pure CaO 15.3% by weight of the initial sulphide material. The resultant mixture was dried until its humidity was about 1 wt.%. The dried charge was continuously fed into a mixer to be mixed therein with continuously fed reusable dust obtained by cleaning of gases during flash smelting. The charge and dust mixture was suspended in a flow of commercial oxygen by means of an oxygen burner so as to be continuously fed into the melting chamber. Specific load in terms of the charge in the melting zone was 50 tons per sq.meter per day. Under the influence of high temperature, the charge was ignited in the presence of oxygen, then melted to produce a dispersed mixture of highly basic slag and metallic copper. Directly under the flame in the zone of flash smelting, the dispersed mixture was separated into two layers in accordance with specific weights, of which one was metallic copper and the other molten slag. The resultant metallic copper and slag were continuously fed into an electric furnace, while gases produced during flash smelting were directed from treatment to be cleaned of dust. The collected dust was reused for flash smelting of the concentrate. The highly basic slag incoming to the electric furnace, containing about 5.5 wt.% copper, 12 wt.% zinc, 2.2 wt.% lead, was treated with coal which was intermittently introduced in an amount of 33 kg per ton of concentrate as calculated in terms of pure carbon (in addition to the stoichiometric required for reduction of copper and zinc oxides, it amounted to 12.7 kg per ton of concentrate). The copper oxide from the molten highly basic slag was reduced by means of carbon to metallic copper which was deposited at the bottom of the electric furnace, with metallic lead partially passing thereinto. Zinc oxide was reduced to metal which evaporized and then was removed together with the residual amount of lead from the electric furnace in the form of vapour-gas phase so as to be thereafter collected after its oxidation in the form of oxidized zinc sublimates. The yield of zinc (in the form of sublimates) was 48 $kg/m^2.h$. Metallic copper and depleted slag were discharged from the electric furnace, whereupon the slag was cooled in the air at a rate of 2.5 deg. per min. The slag discharged from the electric furnace contained 0.46% by weight of copper and 0.75% by weight of zinc. In other words, the waste of these metals with slag amount, respectively, to 1.13 and 4.66% of the amount of copper and zinc fed for smelting.

The test results are given in Table 2.

EXAMPLE 4

A method was carried out as described in Example 15, except that silicate flux in the form of quartz sand (fraction minus 0.5 mm) was additionally introduced into the charge in the presence of basic fluxes as calculated for pure silicon dioxide amounting to 0.45% by weight of the initial sulphide material, with nonferrous metals being finally recovered from the depleted slag after spontaneous disintegration thereof by a flotation method.

The test results are given in Table 2.

EXAMPLE 5

A method was carried out as described in Example 15, except that silicate flux in the form of silicate slag (with a fraction of minus 10 mm) was introduced into the highly basic molten slag obtained during flash smelting of the initial sulphide copper-zinc concentrate. The silicate slag resultant from refining of metallic copper (36.3 wt.% copper, 0.3 wt.% zinc, 9.2 wt.% iron, 0.9 wt.% calcium oxide, 43.5 wt.% silicon dioxide) was taken in an amount of 1.3% by weight of the initial sulphide concentrate, with nonferrous metals being finally recovered from the depleted slag after its spontaneous disintegration by flotation methods.

The test results are given in Table 2.

finally recovered from the depleted slag after its spontaneous disintegration by a flotation method.

The test results are given in Table 2.

EXAMPLE 8

A method was carried out as described in Example 3, except that silicate flux in the form of quartz sand (with a fraction of minus 0.5 mm) was additionally introduced into the charge in the presence of basic fluxes in an amount as calculated in terms of pure silicon dioxide constituting 7.7% by weight of the initial sulphide material, with nonferrous metals being finally recovered from the depleted slag after its spontaneous disintegration by a flotation method.

The test results are given in Table 2.

TABLE 2

Test Results on the Study of Conditions Occurring During Spontaneous Disintegration of Slags

| No. Ex. 1 | Composition of Depleted Slag. wt. % Silicon dioxide 2 | Zinc 3 | Copper 4 | Rate of cooling at which depleted slag is cooled to a temperature of its solidification, deg. per min 5 | Effect of spontaneous disintegration of slag (yes or no) 6 | Production rate at the stage during which zinc is revovered from slag $kg/m^2 \cdot hour$ 7 | Recovery of copper from self-disintegrated slag during flotation, % 8 | Content of copper in flotation concentrate, wt. % 9 | Content of copper in flotation tailings, wt. % 10 | Losses of copper with slag after flotation, % of the initial 11 | Additional recovery in kg per 1000 kg of concentrate 12 |
|---|---|---|---|---|---|---|---|---|---|---|---|
| 3 | 2,3 | 0,75 | 0,46 | 2,5 | No | 48,0 | not recovered | — | — | 1,13 | — |
| 4 | 3,1 | 0,76 | 0,45 | 2,5 | Yes | 46,2 | 67 | 8,1 | 0,15 | 0,38 | — |
| 5 | 4,7 | 0,77 | 0,43 | 2,5 | Yes | 46,5 | 72 | 9,3 | 0,12 | 0,30 | copper: 10,8 |
| 6 | 10,3 | 0,73 | 0,48 | 2,5 | Yes | 53,7 | 73 | 15,2 | 0,13 | 0,38 | zinc: 38,2 |
| 7 | 14,5 | 0,75 | 0,49 | 2,5 | Yes | 48,1 | 71 | 14,9 | 0,14 | 0,35 | copper: 1,5 |
| 8 | 16,5 | 0,77 | 0,48 | 2,5 | Yes | 42,0 | 75 | 15,1 | 0,12 | 0,34 | — |
| 9 | 10,3 | 0,73 | 0,47 | 60 | Yes | 53,8 | 66 | 11,3 | 0,16 | 0,47 | zinc: 38,2 |
| 10 | 10,3 | 0,74 | 0,48 | 70 | No | 53,9 | Not recovered | — | — | 1,34 | Zinc: 38,1 |
| 11 | 10,3 | 0,74 | 0,48 | 0,5 | Yes | 53,5 | 77 | 17,3 | 0,11 | 0,33 | Zinc: 38,0 |
| 12 | 20,0 | 0,80 | 0,49 | 2,5 | Yes | 40,5 | 82 | 11,7 | 0,09 | 0,26 | — |

EXAMPLE 6

A method was carried out as described in Example 3, except that zinc-bearing silicate slag (with a fraction minus 10 mm) was used as the silicate flux introduced into the highly basic molten slag obtained during flash smelting of the initial sulphide concentrate. The silicate slag, containing 20.0 wt.% zinc, 0.64 wt.% copper, 20.8 wt.% iron, 14.7 wt.% calcium oxide and 21.65 wt.% silicon dioxide, was taken in an amount as calculated for pure silicon dioxide constituting 4.35% by weight of the initial sulphide concentrate, with nonferrous metals being finally recovered from the depleted slag after its spontaneous disintegration by a flotation method.

The test results are given in Table 3.

EXAMPLE 7

A method was carried out as described in Example 3, except that depleted silicate slag (with a fraction of minus 10 mm) was used as the silicate flux introduced into the depleted highly basic molten slag. The silicate slag, containing 0.76 wt.% copper, 39.06 wt.% iron, 33.38 wt.% silicon dioxide, 8.72 wt.% calcium oxide was taken in an amount as calculated in terms of pure silicon dioxide constituting 6.6% by weight of the initial sulphide concentrate, with nonferrous metals being

EXAMPLE 9

A method was carried out as described in Example 6, except that the depleted slag was cooled to a temperature of its complete solidification at a rate of 60 deg. per min.

The test results are given in Table 2.

EXAMPLE 10

A method was carried out as described in Example 6, except that the depleted slag was cooled to a temperature of its complete solidification at a rate of 70 deg. per min.

Final recovery of nonferrous metals from the depleted slag by flotation was not carried out because of no effect of spontaneous disintegration of the depleted slag being observed.

The test results are given in Table 3.

EXAMPLE 11

A method was carried out as described in Example 6, except that the depleted slag was cooled to a temperature of its complete solidification at a rate of 0.5 deg. per min.

The test results are given in Table 2.

EXAMPLE 12

A method was carried out as described in Example 3, except that silicate flux in the form of quarts sand (with a fraction of minus 0.5 mm) was additionally introdused into the charge for flash smelting of sulphide copper-zinc concentrate in the presence of basic fluxes in an amount as calculated in terms of pure silicon dioxide constituting 9.6% by weight of the initial sulphide material, with nonferrous metals being finally recovered from the depleted slag after its spontaneous disintegration by a flotation method.

A number of difficulties were encountered at the stage of flash smelting and during treatment of highly basic molten slag with a solid carbonaceous material, which were caused by a high temperature of fusion of the highly basic slag containing 20% by weight of silicon dioxide. Thus, thorough control of the process temperature conditions were to be observed.

The test results are given in Table 2.

As is seen from Table 2, the effect of spontaneous disintegration of slag is observed with the content of silicon dioxide therein being over 3% by weight. However, any increase in this content above 16% by weight is undesirable as it causes difficulties in running the process. Therefore, the higher foundary in the content of silicon dioxide in the depleted slag had been found to be 16% by weight. It proceeds from Table 1 that spontaneous disintegration of slag occurs with the rate of its cooling until complete solidification not exceeding 60 deg. per min. However, to perform the cooling of slag at the rate below 0.5 deg. per min is undesirable since the melt cooling time will exceed 10 hours.

In this case, silicate flux can be introduced either into the charge used for flash smelting of concentrate together with the basic flux, or into the highly basic molten slag resultant from flash smelting and fed further treatment, or else into the highly basic molten slag from which nonferrous metals have been recovered. The silicate slag resultant from refining of metallic copper can be used as the silicate flux; the silicate flux poor in nonferrous metals can also be used along with a silicate flux normally utilized for the purpose.

EXAMPLE 13

Sulphide copper-zinc concentrate with a particle size of minus 74 mcm, containing 8.23 wt.% copper, 1.53 wt.% lead, 18.69 wt.% zinc, 21.41 wt.% iron, 34.22 wt.% sulphur, 6.82 wt.% silicon dioxide, 3.02 wt.% calcium oxide, 0.35 wt.% aluminium oxide, 0.03 wt.% magnesium oxide, was mixed with hydrated limie in an amount, as calculated for pure CaO, of 16.5% by weight of the initial sulphide material. The resultant charge was then dried to a humidity of about 1% by weight.

The dried charge was continuously fed into a mixer to be intermixed therein with reusable dust continuously fed into the mixer after being collected in the process of cleaning gases during flash melting. The mixture of charge and dust was suspended in a flow of commercial oxygen to be thereby transported by means of an oxygen burner into the melting chamber. Under the influence of high temperature, the charge was ignited in the presence of oxygen and then melted to produce a dispersed mixture of highly basic slag and metallic copper. The mixture was then separated in accordance with specific weights into metallic copper and highly basic molten slag. The separated metallic copper was discharged and the molten slag was poured into the electric furnace. The gases produced during flash smelting of the charge were purified to give off dust which was then collected and returned for use in the flash smelting process. The pouring of slag was terminated when its quantity reached 10 tons. At that moment the slag had the following composition, in percent by weight:

copper: 2.12
zinc: 16.92
iron: 22.69
silicon dioxide: 7.22
calcium oxide: 20.69
aluminium oxide: 0.37

Once the slag pouring process was over, coke was charged in batches of 87.8 kg of carbon each (25% of the stoichiometric quantity required for the reduction of copper, zinc and lead) onto the surface of the melt in the electric furnace. Each succeeding portion of coke was charged only after the preceding one was completely used up in the reaction lasting for about 30 min. Immediately before charging carbonaceous material, assays of slag and metallic copper were made to determine the content of valuable components therein. The zinc and lead vapours resultant from treatment of the highly basic slag were discharged from the electric furnace, whereupon they were oxidized in the air and then collected in the form of zinc and lead oxides. After copper, zinc and lead were recovered from the slag, it was discharged from the electric furnace.

The test results are given in Table 3.

From the obtained data it follows that in case of stoichiometric consumption of carbon the waste of nonferrous metals with slag remains rather high, while the excess of carbon above stiochiometric by 20–25% makes it possible to reduce losses of these metals 2–3.5-fold without impairing the quality of metallic copper. It should be observed that in the given Example average specific rate of recovery of zinc from slag until its residual content in the latter was 0.55% by weight, amounted to 127 kg of zinc per sq.meter per hour (minimum amount was 81 and maximum 177 kg/m$^2$.hr). And this was despite the fact that the reduction of oxides was artificially retarded by reducing the rate of charging of the solid carbonaceous material onto the surface of the melt.

TABLE 3

Influence of Carbon Consumption on Process Characteristics Obtained During Treatment of Highly Basic Slag

| Nos | | Carbon consumption, % of the stoichiometric quantity required for reduction of zinc, copper and lead oxides | | | | | | | | | |
|---|---|---|---|---|---|---|---|---|---|---|---|
| | | 0 | 25 | 50 | 75 | 100 | 125 | 150 | 100 | 125 | 150 |
| 1 | 2 | 3 | 4 | 5 | 6 | 7 | 8 | 9 | 7 | 8 | 9 |
| I | Slag composition, wt. % | | | | | | | | | | |
| | copper | 2.12 | 1.67 | 1.29 | 0.90 | 0,55 | 0,24 | 0,16 | 0,55 | 0,24 | 0,16 |
| | zinc | 16.92 | 13.9 | 9.50 | 6.25 | 3,27 | 0,55 | 0,38 | 3,27 | 0,55 | 0,38 |

TABLE 3-continued

| Nos 1 | 2 | Influence of Carbon Consumption on Process Characteristics Obtained During Treatment of Highly Basic Slag — Carbon consumption, % of the stoichiometric quantity required for reduction of zinc, copper and lead oxides: 0 | 25 | 50 | 75 | 100 | 125 | 150 | 100 | 125 | 150 |
|---|---|---|---|---|---|---|---|---|---|---|---|
| | | 3 | 4 | 5 | 6 | 7 | 8 | 9 | 7 | 8 | 9 |
| | lead | 1.65 | 1.03 | 0.57 | 0.28 | 0,09 | 0,03 | 0,01 | 0,09 | 0,03 | 0,01 |
| | iron | 22.69 | 24.19 | 25.61 | 26.96 | 28,22 | 29,33 | 29,30 | 28,22 | 29,33 | 29,30 |
| | silicon dioxide | 7.22 | 7.82 | 8.37 | 8.77 | 9,12 | 9,32 | 9,32 | 9,12 | 9,32 | 9,32 |
| | calcium oxide | 20.7 | 22.2 | 23.3 | 24.6 | 25,6 | 26,7 | 26,8 | 25,6 | 26,7 | 26,8 |
| 2 | Composition of metallic copper obtained during treatment of highly basic melt, wt. % | | | | | | | | | | |
| | copper | — | 91.9 | 91.2 | 89.0 | 85,9 | 85,5 | 86,3 | 85,9 | 85,5 | 86,3 |
| | zinc | — | 0.33 | 0.84 | 1.27 | 1,18 | 0,95 | 0,69 | 1,18 | 0,95 | 0,69 |
| | lead | — | 2.49 | 2.80 | 4.24 | 8,29 | 7,60 | 5,62 | 8,29 | 7,60 | 5,62 |
| | iron | — | 0.23 | 0.23 | 0.26 | 0,27 | 1,55 | 2,11 | 0,27 | 1,55 | 2,11 |
| 3 | Waste of copper with slag, % | 2.50 | 1.90 | 1.39 | 0.92 | 8,54 | 0,23 | 0,16 | 0,54 | 0,23 | 0,16 |
| 4 | Waste of zinc with slag, % | 90.5 | 69.8 | 43.6 | 24.8 | 8,47 | 2,28 | 1,58 | 8,47 | 2,28 | 1,58 |

EXAMPLE 14

Initial sulphide copper-zinc concentrate, containing 22.08 wt.% copper, 8.69 wt.% zinc, 1.59 wt.% lead, 24.41 wt.% iron, 32.71 wt.% sulphur, 1.25 wt.% silicon dioxide, 1.01 wt.% calcium oxide, 0.05 wt.% magnesium oxide, 0.03 wt.% aluminium oxide, was mixed with limestone precrushed to a particle size of minus 1 mm in an amount as calculated in terms of pure CaO constituting 15.3% by weight of the initial sulphide material. The charge thus prepared was dried until its humidity was about 1 wt.% (see Example 3).

The resultant dry charge was continuously fed into a mixer to be mixed therein with reusable dust continuously admitted thereinto after being collected in the process of cleaning gases during flash smelting. The mixture of charge and reusable dust was suspended in a flow of commercial oxygen so as to be continuously fed by means of an oxygen burner into the melting chamber. Specific load of the melting zone was 61 tons per 1 sq.meter per day. Under the influence of high temperature, the charge was ignited and then melted to produce a dispersed mixture of highly basic slag and metallic copper. The dispersed mixture was then separated in accordance with specific weights into metallic copper and highly basic molten slag to be continuously fed into the electric furnace. The gases produced during flash smelting were purified to give off dust which was then returned for use in the process of flash smelting. The highly basic slag admitted into the electric furnace was treated with coal. The consumption of coal per unit of time was altered so as to ensure permanent high concentration of zinc and lead vapours in the electric furnace. In order to determine the concentration of zinc and lead vapours in the electric furnace, the vapour-gas phase was gamma-rayed with two fluxes of different energy. The change in the concentration of zinc and lead vapours was determined in accordance with the change in the intensity of radiation, whereby the feeding rate of the reducing agent was regulated. The consumption of coal was 30 kg per each ton of concentrate calculated for pure carbon (in addition to stoichiometric quantity for reduction of zinc and copper oxides, it amounted to 9.7 kg per ton of concentrate). The copper oxide from the highly basic molten slag was reduced to metallic copper which settled down at the bottom of the electric furnace. The vapour of metallic zinc produced during reduction of zinc oxide was discharged from the electric furnace, whereupon it was oxidized and then collected in the form of oxidized zinc sublimates. The furnace production rate in terms of zinc was 62 kg/m. hour. Metallic copper and depleted slag were discharged from the furnace.

The blister copper produced as described above had the following characteristics:

| Composition, | wt. % | Content of blister copper recovered from the concentrate, % |
|---|---|---|
| Copper | 86.39 | 97.58 |
| Lead | 6.21 | 42.48 |
| Zinc | 1.45 | 2.99 |
| Iron | 1.10 | 1.33 |

The recovery of zinc from the concentrate in the form of zinc sublimates in the electric furnace was 88.99%; the content of lead in zinc sublimates was 55.3%; the content of copper in metallic copper was 98.92%.

EXAMPLE 15

A method was carried out as in Example 14, except that the metallic copper produced during flash smelting was removed from the process after dividing the dispersed mixture of highly basic slag and metallic copper in accordance with specific weights, whereupon the metallic copper produced during treatment of the highly basic molten slag with carbonaceous material was separately removed from the process.

The blister copper produced as described in Example 15 had the following characteristics:

| Composition of blister copper, wt. % | | Yield of blister copper recovered from the concentrate, % |
|---|---|---|
| Metallic copper produced at the stage of reasting | | |
| Copper | 94.09 | 77.67 |
| Lead | 3.54 | 15.42 |
| Zinc | 0.07 | 0.11 |
| Iron | 0.14 | 0.12 |
| Metallic copper produced during depletion of slag | | |
| Copper | 80.30 | 21.16 |
| Lead | 9.10 | 12.38 |
| Zinc | 1.08 | 0.52 |

-continued

| Composition of blister copper, wt. % | | Yield of blister copper recovered from the concentrate, % |
|---|---|---|
| Iron | 2.00 | 0.54 |
| Average characteristics of metallic copper produced at both stages: | | |
| Copper | 90.80 | 98.83 |
| Lead | 4.86 | 27.80 |
| Zinc | 0.31 | 0.63 |
| Iron | 0.58 | 0.66 |

The content of zinc recovered from the concentrate in the form of oxidized zinc sublimates was 94.54%; the content of lead in zinc sublimates was 65.2%; the content of copper in metallic copper was 98.95%.

As is seen from Examples 14 and 15, during separate tapping of metallic copper (after flash smelting and after depletion of the highly basic melt, with almost the same amount of copper being recovered from the concentrate in the form of metallic copper (98.9%), its quality is substantially improved along with an increase in the contents of zinc and lead in oxidized zinc sublimates.

What is claimed is:

1. A method of processing sulphide copper- and/or sulphide copper-zinc concentrates, comprising:

(a) flash smelting, in the presence of oxygen, of a mixture of said concentrates and fluxes selected from the group consisting of basic fluxes and basic fluxes in combination with silicate fluxes; thereby producing a dispersed mixture of highly basic molten slag containing copper and zinc oxides, metallic copper or white matte; said initial concentrates and fluxes being fed for smelting in such ratios that permit production of highly basic slag;

(b) effecting reduction of said copper and zinc oxides, contained in said highly basic molten slag, by means of a solid carbonaceous material with the resultant formation of a vapour-gas mixture, metallic copper and impoverished highly basic slag containing not more than 18 percent by weight of silicon dioxide;

(c) oxidizing the resultant vapour-gas mixture, containing zinc vapour, to zinc oxide;

(d) collecting the resultant zinc oxide.

2. A method as claimed in claim 1, wherein the content of silicon dioxide in the depleted highly basic molten slag is maintained within the range of 3 to 16 percent by weight with the use of silicate flux; said depleted highly basic slag being cooled down to a temperature of its complete solidification at a rate of 0.5 to 60 deg. per minute with the resultant production of self-disintegrating material from which nonferrous metals are finally recovered.

3. A method as claimed in claim 1, wherein the resultant metallic copper is subjected to refining in the presence of silicate fluxes with a view to obtaining refined copper and silicate slag.

4. A method as claimed in claim 1, wherein the metallic copper obtained during flash smelting of the concentrates in the presence of oxygen and the metallic copper obtained during treatment of highly basic molten slag with a carbonaceous material are discharged separately.

5. A method as claimed in claim 1, wherein the silicate slag produced during refining of metallic copper is used as the silicate reflux.

6. A method as claimed in claim 2, wherein the silicate flux is fed for use in flash smelting of the concentrate.

7. A method as claimed in claim 2, wherein the silicate flux is introduced into the molten highly basic slag produced during flash smelting of the concentrate.

8. A method as claimed in claim 2, wherein the silicate flux is introduced into the depleted highly basic molten slag poor in nonferrous metals.

9. A method as claimed in claim 8, wherein the depleted silicate slag poor in nonferrous metals is used as the silicate flux.

10. A method according to claim 1 wherein said basic flux has calcium as a major structure-determining component.

* * * * *